US005769500A

United States Patent [19]

Holbrook

[11] Patent Number: 5,769,500

[45] Date of Patent: Jun. 23, 1998

[54] FURNITURE AND METHOD OF ASSEMBLY

[75] Inventor: Richard Holbrook, Pasadena, Calif.

[73] Assignee: Tropitone Furniture Co., Inc., Irvine, Calif.

[21] Appl. No.: 595,547

[22] Filed: Feb. 1, 1996

[51] Int. Cl.[6] ..... A47C 15/00

[52] U.S. Cl. ..... 297/463.2; 297/452.63

[58] Field of Search ..... 297/440.11, 452.63, 297/452.64, 440.1, 440.2, 440.22, 445.1, 450.1, 452.1, 452.11, 452.18, 452.2, 463.2; 29/428

[56] References Cited

U.S. PATENT DOCUMENTS

| | | | |
|---|---|---|---|
| 3,088,517 | 5/1963 | Schwartz et al. . | |
| 3,114,578 | 12/1963 | Hamilton . | |
| 3,399,926 | 9/1968 | Hehn | 297/452.64 X |
| 3,590,901 | 7/1971 | Dubinsky . | |
| 4,438,800 | 3/1984 | Hemmerle et al. . | |
| 4,456,301 | 6/1984 | Apissomian . | |
| 4,621,866 | 11/1986 | Zani . | |
| 4,730,872 | 3/1988 | Golzer . | |
| 4,910,817 | 3/1990 | Kita . | |
| 5,445,436 | 8/1995 | Kemnitz . | |

FOREIGN PATENT DOCUMENTS

| | | | |
|---|---|---|---|
| 565290 | 7/1957 | Italy | 297/452.63 |

*Primary Examiner*—Milton Nelson, Jr.
*Attorney, Agent, or Firm*—Knobbe, Martens, Olson & Bear, LLP

[57] ABSTRACT

A segment and frame for furniture and a method of assembling the furniture are provided which allow easy installment and removal of the segment by an individual. The segment preferably has rib-like side portions which are received into channels formed on the frame. The length of the segment is substantially the same as the distance between the frame members, so that the need for heating, stretching, and cooling of the segment for attachment to the frame is eliminated, and the assembly or disassembly can easily be performed by a single person. That is, one person can easily attach and secure the segment to the frame without special equipment or using fasteners such as screws or rivets. A single, wide segment or a plurality of segments may be used for the furniture, and decorative surfaces and cutouts can be included in the segments to create a stylish look.

8 Claims, 3 Drawing Sheets

FURNITURE AND METHOD OF ASSEMBLY

BACKGROUND OF THE INVENTION

The present invention relates generally to indoor or outdoor furniture and, in particular, to an improved strap or supporting surface, a method of attaching this supporting surface to a frame and a method of providing a supporting surface for furniture.

Furniture comprising a metal frame having a seat and back formed from straps, typically manufactured from vinyl, is quite popular. Examples of this type of outdoor furniture are disclosed, for example, in U.S. Pat. Nos. 3,114,578 and 5,445,436. However, these furniture pieces typically utilize straps having a width between one and two inches which are cut from long rolls of extruded vinyl. Attaching the straps to the frame requires heating and stretching of the vinyl straps to extend the straps so that they can be wrapped into position around the metal frame, whereby as the vinyl cools, the straps shrink which helps to secure them to the frame. Thus, at least two persons, or one person using a locking fixture to hold the frame down, are required to perform this task. The initial assembly of the furniture as well as any needed repair work is typically performed at the manufacturer's facilities or at a repair facility that is often located far from where the furniture is used.

Common methods of attaching the ends of the vinyl straps to the frame include tabbed ends which are inserted into slots in the frame, plastic rivets received into holes in the frame and various types of clips which grip the end of the strap. However, these methods are generally used in combination with the heating of the vinyl straps for attachment. Further, at least the straps with tabbed ends or rivet attachments are substantially single-point attachments of the strap to the framework. In addition, the clip-type attachment often requires dexterity and strength to mate the end of the strap with the clip and to fix this combination onto the frame.

In view of the foregoing, a need exists for improved furniture that overcomes the problems mentioned.

SUMMARY OF THE INVENTION

The furniture in the present invention comprises an improved segment and frame which are easily assembled in a method of the present invention to provide a supporting surface of the furniture. The furniture may comprise, for example, a bar stool, a chair or a chaise lounge suitable for indoor or outdoor use, such as for patio or poolside furniture.

In one aspect of the present invention, a strap or segment is provided for extending between a pair of members or channeled rails of a frame for an article of furniture and comprises a first side portion for mating with one member and a second or opposite side portion for mating with the other member. An intermediate portion of the segment extends between the members of the frame. Preferably, a rib-like or shaped projection is formed along each of the first and second or opposite side portions and is easily inserted into and removed from a channel formed longitudinally in each member of the frame.

In another aspect of the present invention, an article of furniture is provided and comprises a frame having a pair of members or channeled rails, a strap or segment having first and second shaped side portions and an intermediate section therebetween, and a pair of end caps for securing the segment in the members. The first and second shaped side portions of the segment are readily received into longitudinal channels formed in the members of the frame such that the segment extends between the members. The intermediate section of the segment provides a supporting surface of the furniture for the user. One of the end caps is attached to an end of one member and the other end cap is attached to an end of the other member, thereby securing the strap onto the frame. Alternatively, a lateral member may be used to close the exposed ends of the pair of members which hold the segment side portions.

A method of the present invention for forming an article of furniture comprises:

a) positioning a segment between a pair of members of a frame, an intermediate portion of the segment being substantially equal in length to the distance between the members such that there is no need to stretch the segment;

b) sliding a shaped first side portion of the segment into a channel formed in one of the members; and c) sliding a shaped second or opposite side portion of the segment into a channel formed in the other member, thereby providing a supporting surface of the furniture between the members of the frame. Most preferably, Steps b) and c) are performed substantially simultaneously after Step a).

In this method, Steps a)–c) are repeated if a plurality of segments having shaped side portions are provided. In this case, Steps b) and c) involve closely positioning the shaped side portions of adjacent straps to substantially fill the channels along the length of the members. Further, the method may comprise the step of pressing end caps or providing a lateral member attached to the exposed ends of the members of the frame, thereby further securing the segment onto the frame. Also, the steps of removing the end caps and removing one or more segments by sliding the segments along the channel may be performed for the replacement or rearranging of the segments.

Thus, the present invention provides a segment and frame for furniture and a method of assembling the furniture which allow easy installment and removal of the segment by an individual. Preferably, the segment has shaped side portions which are received into channels formed on the frame. The length of the segment is substantially the same as the distance between the frame members, so that the need for heating, stretching, and cooling of the segment onto the frame, as well as the need for attachment hardware, is eliminated; thus, the assembly or disassembly can easily be performed by a single person. That is, one person can easily attach and secure the segment onto the frame without special equipment or the need for rivets, screws or any other fastener. Preferably, injection-molded vinyl segments are used, although other forms of manufacturing, such as extruding or casting, for example, may be used with other flexible or rigid materials. A single, wide segment or a plurality of segments may be used for the furniture, and decorative surfaces and/or openings can be included to create a custom look.

Further advantages and applications will become apparent to those skilled in the art from the following detailed description and the drawings referenced herein.

DETAILED DESCRIPTION OF THE PREFERRED EMBODIMENTS

The present invention comprises an improved segment or strap and frame for patio furniture which are easily assembled in a method of the present invention to provide a supporting surface of the furniture. The supporting surface may be for seating or resting the head, arms, back or feet of a person thereon. The furniture may comprise, for example, a bar stool, a chair or a chaise lounge suitable for indoor or outdoor use. However, the present invention may easily be adapted to other articles of furniture as will be readily understood by those of skill in the art. The need for heating, stretching, and cooling of the segment or strap onto the frame is eliminated, and the assembly or disassembly can easily be performed by a single person. Further, neither attachment hardware, such as screws or rivets, nor additional equipment are required for securing the segments onto the frame. Preferably, injection-molded vinyl straps are used; although, other flexible or rigid materials may be used in conjunction with other manufacturing methods, such as forming, extruding, stamping or casting, for example. A single, wide segment or a plurality of segments may be used in connection with the furniture of the present invention, and decorative surfaces and/or openings can be included in the segment(s) or strap(s) to create a custom look.

Figure 1:
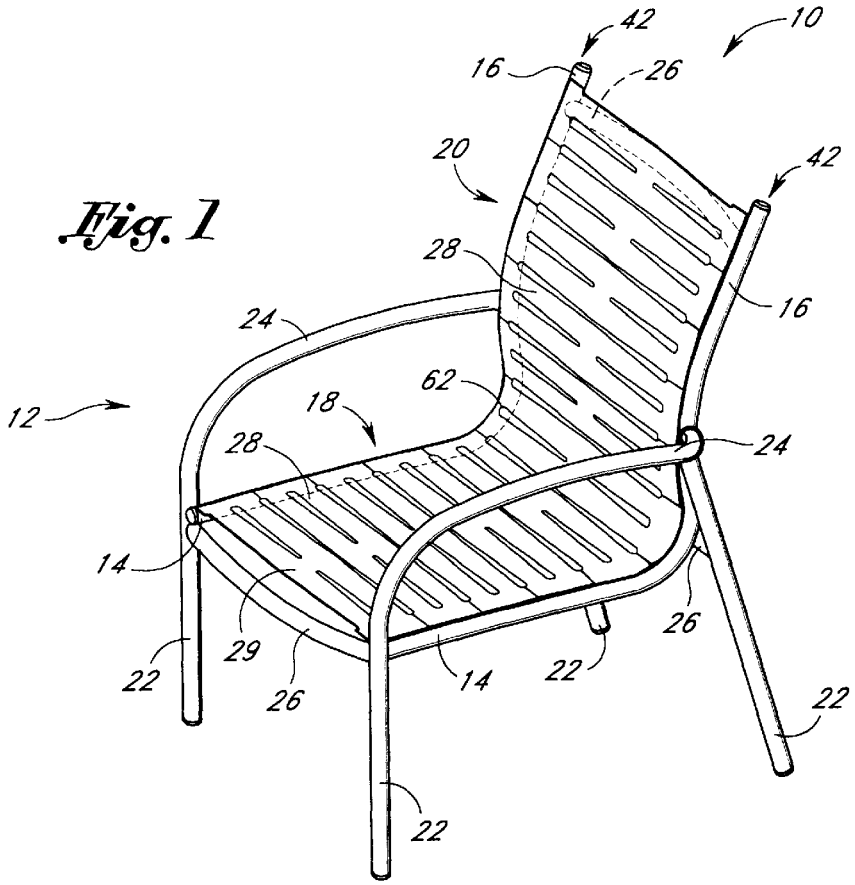
FIG. 1 shows a perspective view of a chair constructed in accordance with the present invention.

Referring now to the figures, a chair 10 constructed in accordance with the present invention is illustrated in FIG. 1. However, it is understood that a barstool, chaise lounge or other article of furniture may likewise be constructed in accordance with the present invention. A frame 12 comprising pairs of tubular members or channeled rails 14, 16 provides a person with a seating surface 18 and back support 20, respectively. Additionally, the frame comprises leg and arm member pairs 22, 24, and structural supports 26 are preferably included near the front and rear of the seating surface 18 and behind the back support 20 of the frame 12. A popular style for patio furniture is shown, wherein the leg and arm members 22, 24 and the seating and back support members 14, 16 are of unitary construction and provide a somewhat curved shape to the chair 10. Other chair designs may have the seating support, back support and/or each of the leg and arm members 14, 16, 22, 24 formed separately or in different styles or shapes, as will be readily understood by those of skill in the art. For example, the members or channeled rails 14 may alternatively be welded at their forward ends to the front legs 22, rather than tangentially welded to the legs 22, as shown, or the members 14 may be welded directly to the front support 26.

Figure 2:
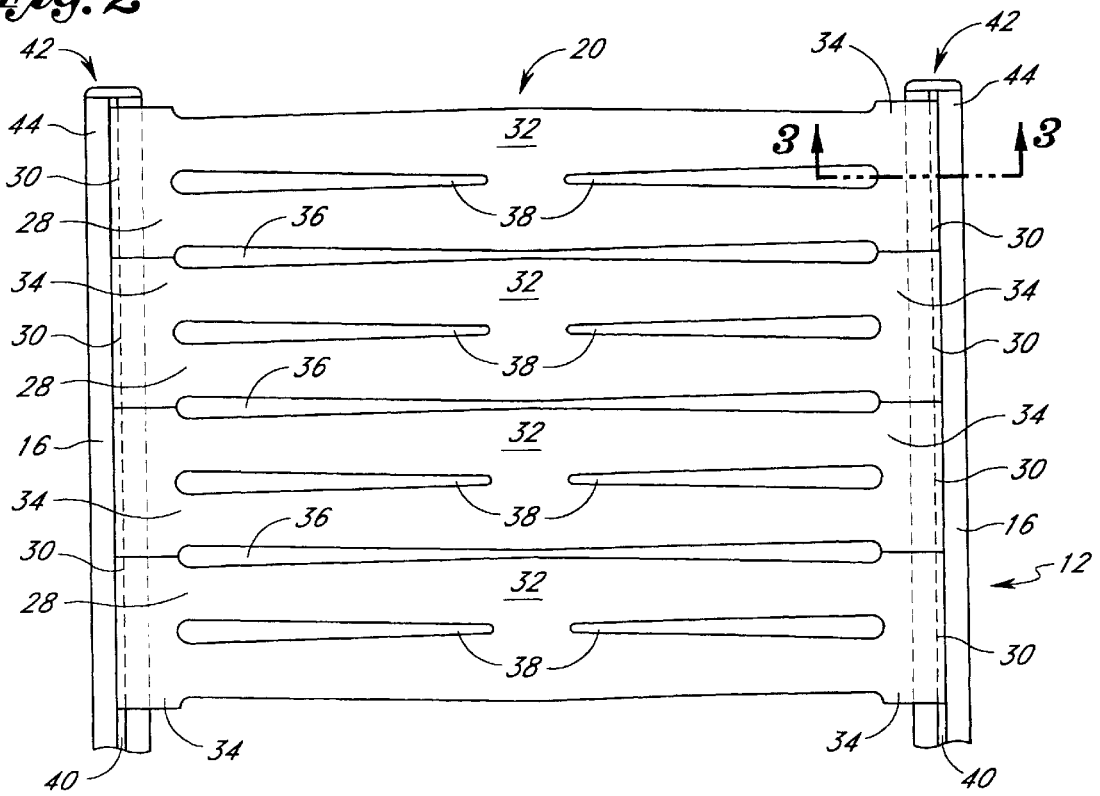
FIG. 2 is a front view of the upper back portion of the chair of FIG. 1, illustrating the preferred arrangement of the segments adjacent one another.

Referring now to FIG. 2, a plurality of straps or segments 28 of the present invention are shown in a front view of the upper portion of the back support 20 of the chair 10 of FIG. 1. In alternative embodiments, a single, wider segment or strap may be used to support the back of a user. Similarly, a single, wider strap may be used for the seating surface 18 of the chair 10. Although the present invention will be described in detail with regard to the back support 20 of the chair 10 (FIG. 2), it is understood that the description further applies to the straps 28 and members 14 of the seating surface 18 as well as any supporting surface for other body parts, such as the head, arms or feet, if provided. In FIG. 2, the plurality of straps 28 extend between the pair of back support members 16 and comprise side portions 30 and an intermediate portion 32. Preferably, the intermediate portion 32 is wider at its ends 34 so that a space 36 formed between the intermediate portions of adjacent straps 28 is mirrored by cutouts 38 formed in the middle of the intermediate portions 32. In alternative embodiments, the intermediate portion 32 may be narrower at its ends 34 or have substantially the same width at the ends 34 as at its middle. More or less cutouts and other decorative finishes, such as embossed or painted designs, may also be included on the intermediate portion 32 of the straps 28.

As shown in FIG. 2, the members or channeled rails 16 have openings or channel openings 40 extending longitudinally along their lengths. During assembly of the furniture, these channel openings 40 are positioned upwardly. The shaped side portions 30 of the straps 28 are received in these channel openings 40 in a manner described below. If a single strap is used, it is preferred that the side portions 30 of the strap 28 are sufficient to cover the length of each member 16 to cover the channel openings 40. Preferably, end caps 42 are provided at exposed ends 44 of the members 16 to secure the side portions 30 of the straps 28 on the frame 12. Generally, if one end of a member is directly welded or attached to another, substantially orthogonal member of the furniture, only the exposed end of the member requires an end cap 42 to secure the strap or segment 28. Alternatively, a lateral member (not shown), comprising a generally U-shaped bar, may be used to close the exposed ends 44 of the pair of members 16 and extend therebetween. In the present invention, the straps 28 are formed to have a length substantially equal to the distance between the channel openings 40 in the members 16. That is, no stretching of the straps 28 is required to position the side portions 30 in the channel openings 40 of the members 16 in a method of assembly of the present invention which is described herein.

Figure 3:
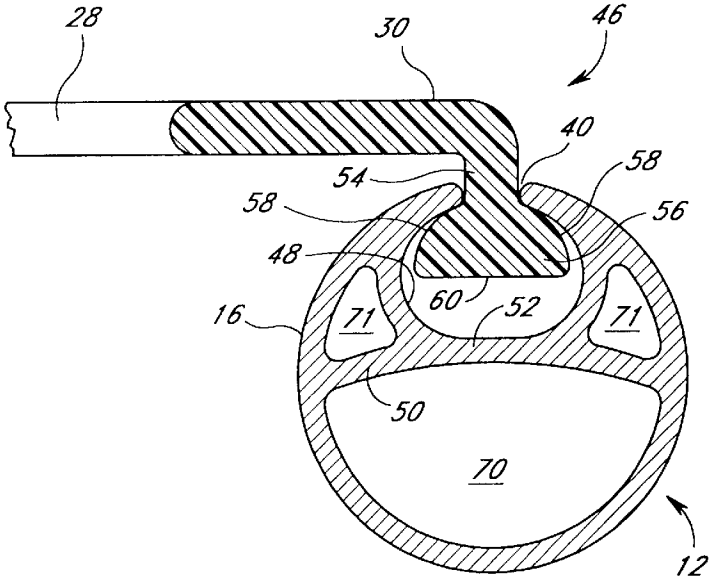
FIG. 3 is a cross-sectional view taken along lines 3—3 in FIG. 2.

A preferred shape of the side portions 30 of the straps 28 is shown in FIGS. 3–6. It is understood, however, that alternative shapes, such as cylindrical or triangular, for example, may be used for the side portions 30 of the straps 28 without loss of the advantages of the present invention. FIG. 3 shows the manner in which a somewhat rib-like or shaped projection 46 of the side portion 30 is positioned in the channel opening 40. Preferably, the frame 12 is formed of substantially hollow aluminum tubing, although other metal or plastic frame members 16 with non-cylindrical shapes may be used in the present invention. A longitudinally extending chamber or channel 48 is formed inside the member 16, and preferably a reinforcing section 50 of metal extends substantially the diameter of the member 16 and partially forms a floor 52 of the channel 48. In alternative embodiments, the member 16 may be substantially solid and have a triangular or other shaped channel formed longitudinally. As will be recognized by those of skill in the art, the members 16 may be manufactured of a variety of materials and incorporate a variety of cross-sectional configurations.

Figure 5:
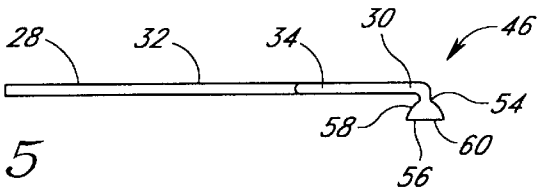

It is preferred that the straps 28 comprise a vinyl material formed by injection-molding techniques known to those skilled in the art, thereby providing durable straps 28 of presized lengths and customized decoration. In alternative embodiments, other flexible or rigid materials may be used for the straps 28, and other manufacturing techniques, such as forming, extruding, stamping or casting the straps 28 may be utilized. Or, techniques using heat, pressure, machining or a combination thereof may be used to form the straps 28. Referring to FIG. 5, the shaped projection 46 of the side portion 30 of the strap 28 preferably comprises a short straight section 54 extending substantially orthogonally to the intermediate portion 32 and a larger bulb section 56 extending substantially parallel to the intermediate portion 32 of the strap 28. Alternatively, the section 54 may extend substantially parallel to the portion 32 for use with a channel opening 40 positioned on the member 16 about 90 degrees from that shown in FIG. 3, rotated either clockwise or counterclockwise. In this arrangement, the bulb section 56 extends substantially orthogonal to the intermediate portion 32. That is, the channel openings 40 in the members 16 may face each other, face the same direction as shown in FIG. 1, or face away from each other. During use, the bulb section 56 of the shaped projection 46 tightly engages into the channel opening 40 in the member 16 and resists the force on the strap 28 which would otherwise pull the side portions 30 out of the channels 48.

Figure 4:
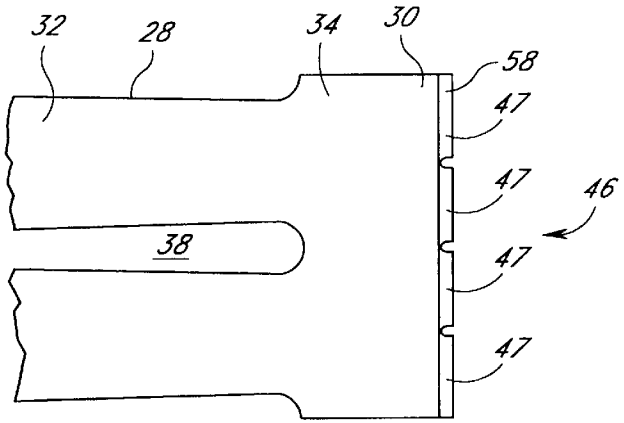
FIGS. 4–6 are top plan, side elevational and bottom plan views respectively, of a side portion of a segment of the present invention.
Figure 6:
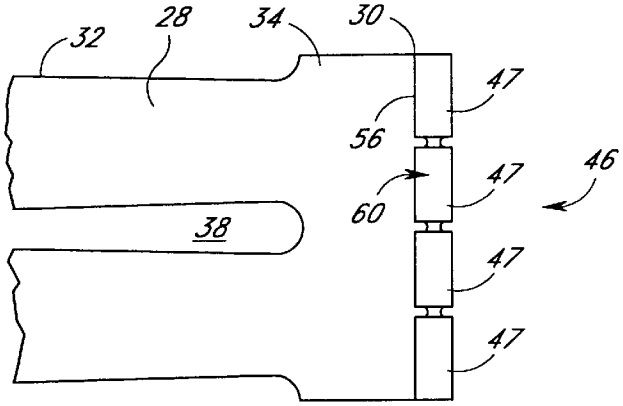

The bulb section 56 of the projection 46 is preferably rounded at surfaces 58 closer to the remainder of the strap 28 and flat at an opposite surface 60. In alternative embodiments, however, the rib-shaped projection 46 may comprise a substantially cylindrical shape, triangular shape or other shape for engagement in the channel 48 of the frame member 16. As shown in FIGS. 4 and 6, the rib-like side portion 30 of the strap 28 is preferably formed in sections 47 to allow greater lateral flexibility for positioning at curved portions 62 of the frame 12 (see FIG. 1). Although, in alternative embodiments the portions 30 may be formed as a single, solid section rather than a plurality of sections 47.

Figure 9:
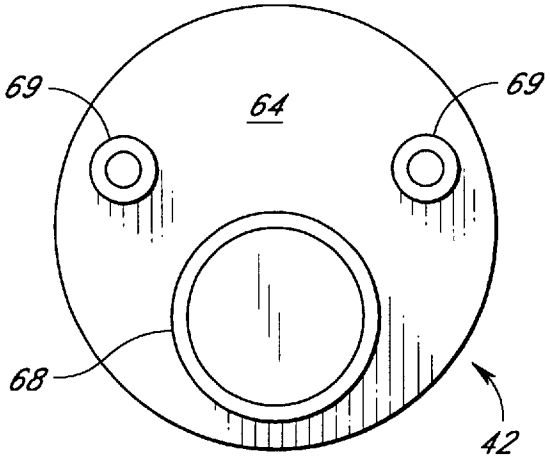
FIGS. 7–9 are top plan, side elevational and bottom plan views, respectively, of an end cap of the present invention.
Figure 8:
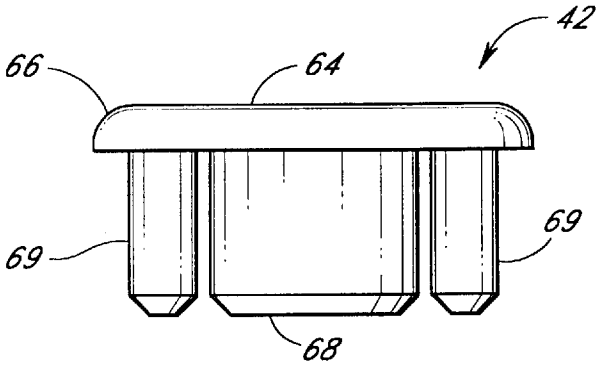
Figure 7:
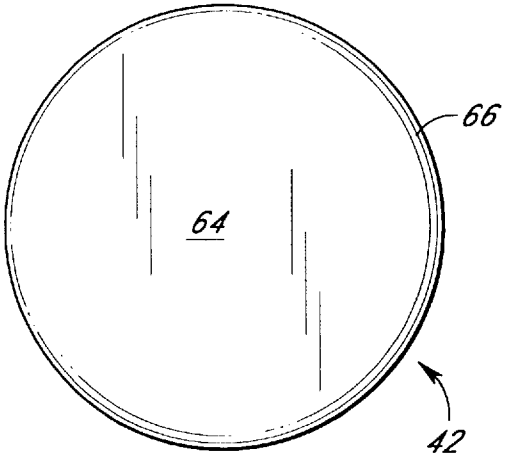

Once the strap or straps 28 are positioned as desired on the frame 12, the end cap 42 shown in FIG. 2 is press-fit onto the end 44 of each member 16. Referring to FIGS. 7–9, an exposed section 64 of the cap 42 should conform generally in shape to the cross-section of the member 16 and have smooth, rounded edges 66 as best shown in FIGS. 7 and 8. Another section 68 of the cap 42 is preferably placed within the end 44 of the member 16 and has a shape that facilitates the holding of the cap 42 firmly into a space 70 formed inside the member 16 (FIG. 3). Also preferably, posts 69 are received in additional spaces 71 inside the member 16. In alternative embodiments, instead of shaping the section 68 to the space 70 in the member 16, the cap 42 may have a sleeve fitting around the circumference of the member 16, with a space to accommodate the side portion 30 of the strap 28 which is positioned at the end 44 of the member 16.

Method of Assembly of the Furniture

A method of the present invention for forming an article of furniture 10 comprises:

a) positioning a strap or segment 28 between a pair of members 16 of a frame 12, an intermediate portion 32 of the strap 28 being substantially equal in length to the distance between the members 16 such that there is no need to stretch the strap 28;

b) sliding a shaped projection 46 of a first side portion 30 of the strap 28 into a channel 48 formed in one member 16; and c) sliding a shaped projection 46 of a second or opposite side portion 30 of the strap 28 into a channel 48 formed in the other member 16, thereby providing a supporting surface 29 of the furniture 10 between the members 16 of the frame 12 without the need for attachment hardware or fasteners such as rivets or screws. Although Step b) may be performed prior to Step a), it is most preferred that concurrent placement of the rib-like side portions 30 into the channels 48 of the pair of members 16 is performed. That is, preferably, the strap 28 is extended so that the rib-like side portions 30 are positioned near the ends 44 of the members 16, and then the rib-like side portions 30 are substantially simultaneously slid into the channels 48 and into the desired position on the frame 12. Thus, no special equipment is required to hold the frame 12 while the strap or straps 28 are attached.

In this method, Steps a)–c) are repeated if a plurality of straps 28 having rib-like side portions 30 are provided. In this case, Steps b) and c) comprise closely positioning the rib-like or shaped side portions 30 of adjacent segments 28 to substantially fill the channel openings 40 along the length of the members 16. Further, the method may comprise the step of pressing end caps 42 into or onto the exposed ends 44 of the members 16 of the frame 12, thereby securing the strap(s) 28 onto the frame 12. Also, the steps of removing the end caps 42 and removing one or more straps 28 may be performed for their replacement or rearrangement. As will be easily understood by those of skill in the art, either end, or both ends of the pairs of members 14, 16 of the frame 12 may be adapted to receive the strap(s) 28 into the channel openings 40 and/or the end caps 42.

In the present invention, the need for heating, stretching, and cooling of the strap 28 onto the frame 12 to form a supporting surface 18, 20 and the need for any attachment hardware or special equipment is eliminated, and the assembly or disassembly can easily be performed by a single person. Preferably, injection-molding techniques are used to provide patterns and textures as desired for the strap 28; although, other manufacturing techniques and strap materials as described herein may alternatively be used. Thus, a single, wide strap or a plurality of straps 28 may be used for the furniture, and decorative surfaces, including logos or initials and/or cutouts, can be included to create a custom look. A single person can choose the design wanted for the furniture and place the straps 28 accordingly without great effort. When a strap 28 needs repair or replacement, or to evenly distribute the wear of a plurality of straps 28, the consumer can do so himself/herself by purchasing the necessary strap or straps 28 and following the steps described above. In addition, the consumer may replace the straps with straps of a different design to inexpensively obtain furniture of a different style or look.

The embodiments illustrated and described above are provided merely as examples of the strap and frame for furniture and the method of assembly thereof. Other changes and modifications can be made from the embodiments presented herein by those skilled in the art without departure from the spirit and scope of the invention, as defined by the following claims.

What is claimed is:

1. A method of forming an article of furniture for seating thereon, said method comprising:

a) positioning a segment to extend between a pair of members of a frame of the article of furniture, said segment having an intermediate portion formed between first and second shaped side portions, said side portions having first and second widths, said intermediate portion substantially equal in length to the distance between said pair of members such that heating and stretching of said segment is not required;

b) sliding said first shaped side portion of said segment into a first channel formed in one of said members, said first channel having an opening, said opening having a third width, said first width being greater than said third width; and c) sliding said second shaped side portion of said segment into a second channel formed in the other of said members said second channel having an opening, said opening having a fourth width, said second width being greater that said fourth width, thereby providing a supporting surface of said article between said members of said frame.

2. The method of claim 1, wherein Steps a)–c) are repeated for a plurality of segments having shaped side portions and Steps b) and c) comprise closely positioning said shaped side portions of adjacent segments to substantially fill said channels along the length of said members.

3. The method of claim 1, wherein Steps b) and c) are performed substantially simultaneously after Step a).

4. The method of claim 1, wherein Step b) or c) is performed prior to Step a).

5. The method of claim 1, further comprising the step of pressing end caps into exposed ends of said members of said frame thereby securing said segment and said frame.

6. The method of claim 5, further comprising the steps of removing said end caps and slidably removing said shaped side portions of said segment from said channels of said pair of members for the replacement or rearrangement of said segment.

7. A method of forming an article of furniture for seating thereon, the article having a frame having a pair of members with a space therebetween, said members having longitudinal channels extending substantially the entire length of said members, said channels having longitudinal openings having first and second widths, said method comprising:

a) providing a strap for forming a supporting surface of the article of furniture, said strap having shaped side portions extending at least partially orthogonal to an intermediate portion of said strap, said side portions having third and fourth widths;

b) positioning said intermediate portion of said strap across the space between said pair of members of the frame; and c) sliding said side portions of said strap into the channels of the members;

wherein said first width is smaller than said third width, said second width is smaller than said fourth width and said positioning and sliding of Steps b) and c) are performed without significant stretching or tensioning of said strap in order to position said side portions across said space and in the channels of the members.

8. A method of forming an article of furniture for seating thereon, the article having a frame having a pair of members with a space therebetween, the members having longitudinal channels extending substantially the entire length of the members, said channels having openings having first and second widths, said method comprising:

a) providing a strap at ambient temperature for forming a supporting surface of the article of furniture, said strap having shaped side portions extending at least partially orthogonal to an intermediate portion of said strap, said side portions having third and fourth widths;

b) positioning said intermediate portion of said strap at the ambient temperature across the space between the pair of members of the frame; and c) sliding said side portions of said strap at the ambient temperature into the channels of the members;

wherein said positioning and sliding of Steps b) and c) are performed without heating of said strap above the ambient temperature, said first width is smaller than said third width and said second width is smaller than said fourth width.

* * * * *